United States Patent [19]

Barr

[11] Patent Number: 4,558,753

[45] Date of Patent: Dec. 17, 1985

[54] DRAG BIT AND CUTTERS

[75] Inventor: John D. Barr, Cheltenham, United Kingdom

[73] Assignee: NL Industries, Inc., New York, N.Y.

[21] Appl. No.: 468,669

[22] Filed: Feb. 22, 1983

[51] Int. Cl.[4] ..... E21B 10/46

[52] U.S. Cl. ..... 175/329; 175/410; 175/379

[58] Field of Search ..... 175/329, 330, 379, 383, 175/410; 407/42, 33, 116, 118

[56] References Cited

U.S. PATENT DOCUMENTS

| | | | |
|---|---|---|---|
| 1,025,735 | 5/1912 | Bosredon | 407/118 X |
| 1,835,701 | 12/1931 | Edmunds | 299/79 X |
| 1,859,717 | 5/1932 | Rutrle | 175/385 |
| 2,033,594 | 3/1936 | Stoody | 407/118 |
| 2,072,470 | 3/1937 | Thompson | 175/413 X |
| 2,998,088 | 8/1961 | Pennington, II | 175/329 |
| 3,239,275 | 3/1966 | Belugou | 299/79 |
| 3,882,749 | 5/1975 | Tourek | 83/651 |
| 4,199,035 | 4/1980 | Thompson | 175/410 |
| 4,350,215 | 9/1982 | Radtke | 175/329 |
| 4,351,401 | 9/1982 | Fielder | 175/329 |

FOREIGN PATENT DOCUMENTS

| | | | |
|---|---|---|---|
| 1228941 | 3/1960 | France | 175/410 |
| 2095724 | 10/1982 | United Kingdom . | |

*Primary Examiner*—James A. Leppink
*Assistant Examiner*—Hoang C. Dang
*Attorney, Agent, or Firm*—Browning, Bushman, Zamecki & Anderson

[57] ABSTRACT

A drill bit comprises a bit body having an operating end face. A plurality of self-sharpening cutters are mounted in the bit body and extend through the operating end face. The cutters have cutting faces adapted to engage an earth formation and cut the earth formation to a desired three-dimensional profile. The cutting faces define surfaces having back rake angles which decrease with distance from the profile. The individual cutting faces may be inwardly concave in a plane parallel to the intended direction of motion of the cutter in use.

26 Claims, 13 Drawing Figures

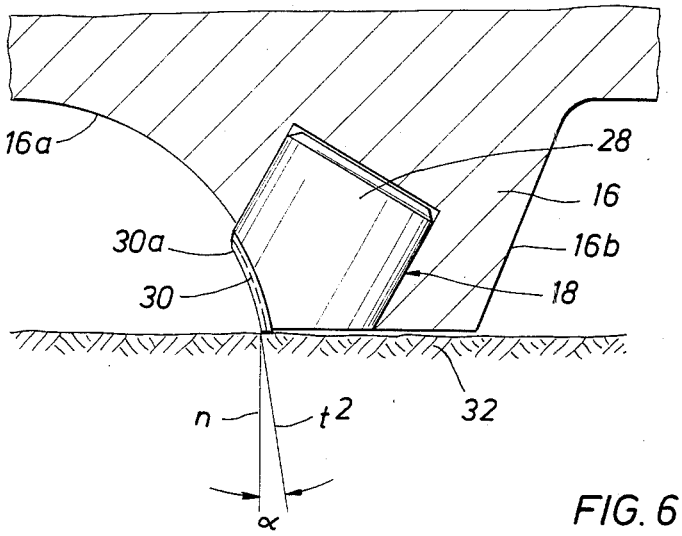
FIG. 6
FIG. 5
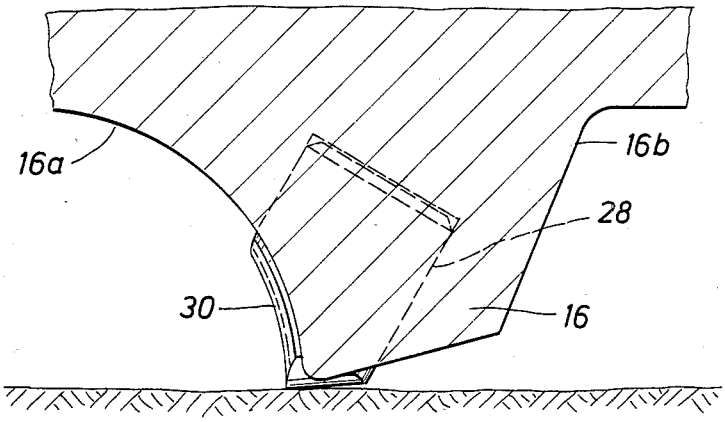

FIG.9
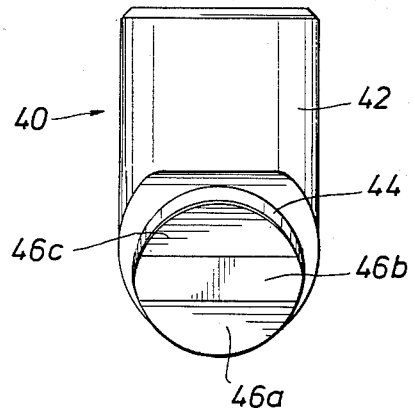
FIG.10
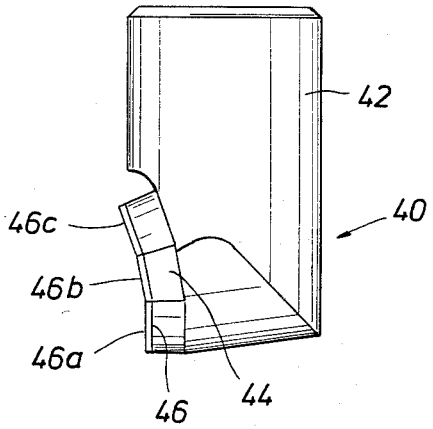
FIG.11
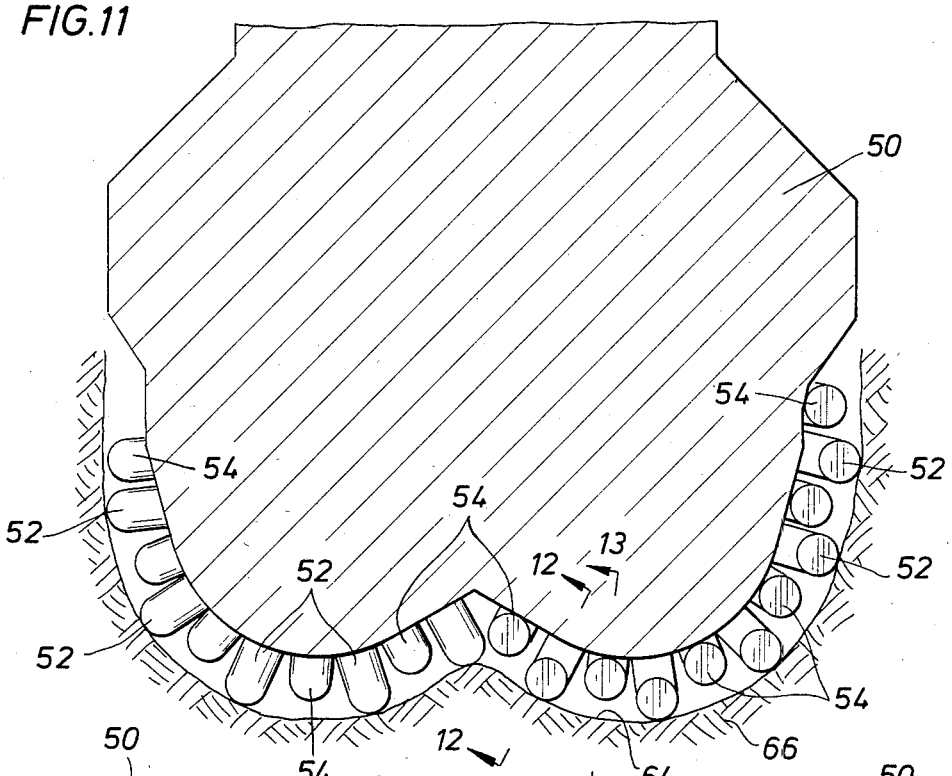
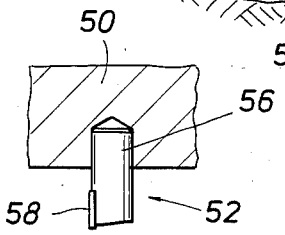
FIG.12
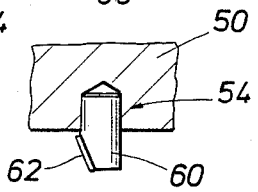
FIG.13

DRAG BIT AND CUTTERS

BACKGROUND OF THE INVENTION

The invention pertains to drag-type drill bits, and, more particularly, to the type of drag bit in which a plurality of cutting members are mounted in a bit body. Such cutting members are formed with a cutting face terminating in a relatively sharp cutting edge for engaging the earth formation to be drilled. In use, the cutting members wear. If the cutting members were formed of a single or uniform material, such wear would occur in a pattern which would cause the original sharp edge to be replaced by a relatively broad flat surface contacting the earth formation over substantially its entire surface area. Such flats are extremely undesirable in that they increase frictional forces, which in turn increases the heat generated and the torque and power requirements.

Accordingly, most such cutting members comprise a stud or similar mounting body formed of one material and carrying a layer of substantially harder material which defines the cutting face. Typically, the mounting body is comprised of cemented tungsten carbide, while the layer defining the cutting face is comprised of polycrystalline diamond or other superhard material. Such use of layers of different materials renders the cutting members "self-sharpening" in the sense that, in use, the member will resist becoming blunt by tending to renew its cutting edge. The tungsten carbide material will tend to wear away more easily than the polycrystalline diamond material. This causes the development of a small step or clearance at the juncture of the two materials so that the earth formation continues to be contacted and cut substantially only by the edge of the diamond layer, the tungsten carbide substrate having little or no high pressure contact with the earth formation. Because the diamond layer is relatively thin, the edge thus maintained is sharp.

It has been found that the effectiveness of such setting members and the bit in which they are employed can be improved by proper arrangement of the cutting members, and more specifically, their cutting faces, with respect to the body of the drill bit, and thus, to the earth formation being cut. The cutting faces are typically planar (although outwardly convex cutting faces are known). The cutting members can be mounted on the bit so that such planar cutting faces have some degree of side rake and/or back rate. Any given drill bit is designed to cut the earth formation to a desired three dimensional "profile" which generally parallels the configuration of the operating end of the drill bit. "Side rake" can be technically defined as the complement of the angle between (1) a given cutting face and (2) a vector in the direction of motion of said cutting face in use, the angle being measured in a plane tangential to the earth formation profile at the closest adjacent point. As a practical matter, a cutting face has some degree of side rake if it is not aligned in a strictly radial direction with respect to the end face of the bit as a whole, but rather, has both radial and tangential components of direction. "Back rake" can be technically defined as the angle between (1) the cutting face and (2) the normal to the earth formation profile at the closest adjacent point, measured in a plane containing the direction of motion of the cutting member, e.g. a plane perpendicular to both the cutting face and the adjacent portion of the earth formation profile (assuming a side rake angle of 0°). If the aforementioned normal falls within the cutting member, then the back rake is negative; if the normal falls outside the cutting member, the back rake is positive. As a practical matter, back rake can be considered a canting of the cutting face with respect to the adjacent portion of the earth formation profile, i.e. "local profile," with the rake being negative if the cutting edge is the trailing edge of the overall cutting face in use and positive if the cutting edge is the leading edge.

Substantial positive back rake angles have seldom, if ever, been used. Thus, in the terminology of the art, a negative back rake angle is often referred to as relatively "large" or "small" in the sense of its absolute value. For example, a back rake angle of −20° would be considered larger than a zero back rake angle, and a back rake angle of −30° would be considered still larger.

Proper selection of the back rake angle is particularly important in adapting a bit and its cutting members for most efficient drilling in a given type of earth formation. In soft formations, relatively small cutting forces may be used so that cutter damage problems are minimized. It thus becomes possible, and indeed preferable, to utilize a relatively small back rake angle, i.e. a very slight negative rake angle, a zero rake angle, or even a slight positive rake angle, since such angles permit fast drilling and optimize specific energy. However, in hard rock, it is necessary to use a relatively large rake angle, i.e. a significant negative rake angle, in order to avoid excessive wear in the form of breakage or chipping of the cutting members due to the higher cutting forces which become necessary.

Problems arise in drilling through stratified formations in which the different strata vary in hardness as well as in drilling through formations which, while substantially comprised of relatively soft material, contain "stringers" of hard rock. In the past, one of the most conservative approaches to this problem was to utilize a substantially negative back rake angle, e.g. −20°, for the entire drilling operation. This would ensure that, if or when hard rock was encountered, it would be drilled without damage to the cutting members. However, this approach is unacceptable, particularly where it is known that a substantial portion, and specifically the uppermost portion, of the formation to be drilled is soft, because the substantial negative back rake angle unduly limits the speed of drilling in the soft formation.

Another approach, applicable where the formation is stratified, is to utilize a bit whose cutting members have smaller zero back rake angles to drill through the soft formation and then change bits and drill through the hard formation with a bit whose cutting members have larger back rake angles, e.g. −20° or more. This approach is unsatisfactory because of the time and expense of a special "trip" of the drill string for the purpose of changing bits.

It is believed that the formation is uniformly soft, a somewhat daring approach is to utilize the relatively small back rake angle in order to maximize the penetration rate. However, if a hard stringer is encountered, catastrophic failures can result. For example, severe chipping of only a single cutting member increases the load on neighboring cutting members and shortens their life resulting in a premature "ring out," i.e. a condition in which the bit is effectively inoperative.

SUMMARY OF THE INVENTION

In a bit according to the present invention, the cutting faces of the cutting members define surfaces having back rake angles which become more negative with distance from the earth formation profile. The terminology "more negative" is not meant to imply that the back rake angle closest to the profile is negative. Indeed, one of the advantages of the invention is that it makes the use of zero or slightly positive angles more feasible. Thus, the term is simply intended to mean that the values of the angles vary in the negative direction—with distance from the profile—whether beginning with a positive, zero or negative value.

This effect can be accomplished by at least two basic schemes. In one such scheme, there are at least two sets of cutting members, one set having its cutting faces disposed closer to the operating end face of the bit body than the cutting faces of the other set. The back rake angles of the cutting faces of the one or innermost set are more negative than the back rake angles of the cutting faces of the other or outermost set. As the bit begins to operate, only the outermost set of cutters, having the less negative back rake angles, will contact and cut the formation. Thus, the bit will be able to progress rapidly through the soft formation which is typically uppermost. If a hard stringer is encountered, or if the bit reaches the end of a soft stratum and beings to enter a hard stratum, the outermost set of cutters will quickly chip or break away so that the innermost set, having more negative rake angles, will be presented to the earth formation and begin drilling. This other set of cutters, with its relatively large rake angles, will be able to drill the hard rock without excessive wear or damage. If, subsequently, soft formation is again encountered, the second set of cutters can still continue drilling acceptably, albeit at a slower rate of speed than the first set.

A second basic scheme for providing the aforementioned varying rake angles is to form the cutting face of each individual cutting member so that it defines a number of different back rake angles from its outermost to its innermost edge. For example, the cutting face can define a curved concave surface, or a succession of planar surfaces or flats approximating such a curve. This scheme provides essentially all the advantages of the first scheme described above and, in addition, more readily provides a greater number of potential back rake angles. The system is self-adjusting in the sense that, when hard rock is encountered, the cutters will wear rapidly only to the point where they present a sufficiently negative back rake angle to efficiently cut the formation in question. At that point, the chipping or rapid wear will cease and the cutters will continue drilling the formation essentially as if their rake angles had been initially tailored to the particular type of rock encountered.

The use of such concave cutting faces on the individual cutting members has a number of other advantages, which can be further enhanced by complementary design features in the bit body. For example, the shape of the cutting faces may enhance the hydraulics across the operating end face of the bit and may also have a "chip breaker" effect. The bit body itself can be designed to further cooperate in the enhancement of the hydraulics as well as to provide maximum support for the cutting member adjacent to and opposite its cutting face.

Another advantage, particularly in those forms of the invention utilizing concave cutting faces on the individual cutting members, is that, in the event of severe wear, the extremely negative back rake angle which will be presented to the formation will effectively stop bit penetration in time to prevent the formation of junk by massive destruction of the bit.

It can readily be appreciated that the present invention can dramatically extend the life of a bit, or if extended life (or improved reliability) is not required, cost of manufacture can be reduced by providing fewer cutters on a bit to achieve the same life as a conventional bit.

Accordingly, it is a principal object of the invention to provide an improved drag-type drilling bit.

Another object of the present invention is to provide an improved, self-sharpening cutter for such a bit.

Still another object of the present invention is to provide such a bit wherein the cutting faces of the cutting members define surfaces having back rake angles which become more negative with distance from the earth formation profile.

A further object of the present invention is to provide an improved, self-sharpening cutter having an inwardly concave cutting face.

Still other objects, features and advantages of the present invention will be made apparent by the following detailed description, the drawings and the claims.

BRIEF DESCRIPTION OF THE DRAWINGS

FIG. 5 is a view similar to that of FIG. 3 taken in a different plane.

FIG. 6 is a view similar to that of FIG. 3 showing the adjustment to a lower back rake angle upon encountering hard rock.

FIG. 9 is a front elevational view of the third embodiment of cutting member.

FIG. 10 is a side elevational view of the cutting member of FIG. 9.

FIG. 11 is a schematic view of a bit according to another embodiment of the invention.

FIG. 12 is a detailed view of one of the first set of cutting members of the embodiment of FIG. 11 taken along line 12—12 thereof.

FIG. 13 is a detailed view of one of the second set of cutting members of the embodiment of FIG. 11 taken along line 13—13 thereof.

DETAILED DESCRIPTION OF THE PREFERRED EMBODIMENT

Figure 1:
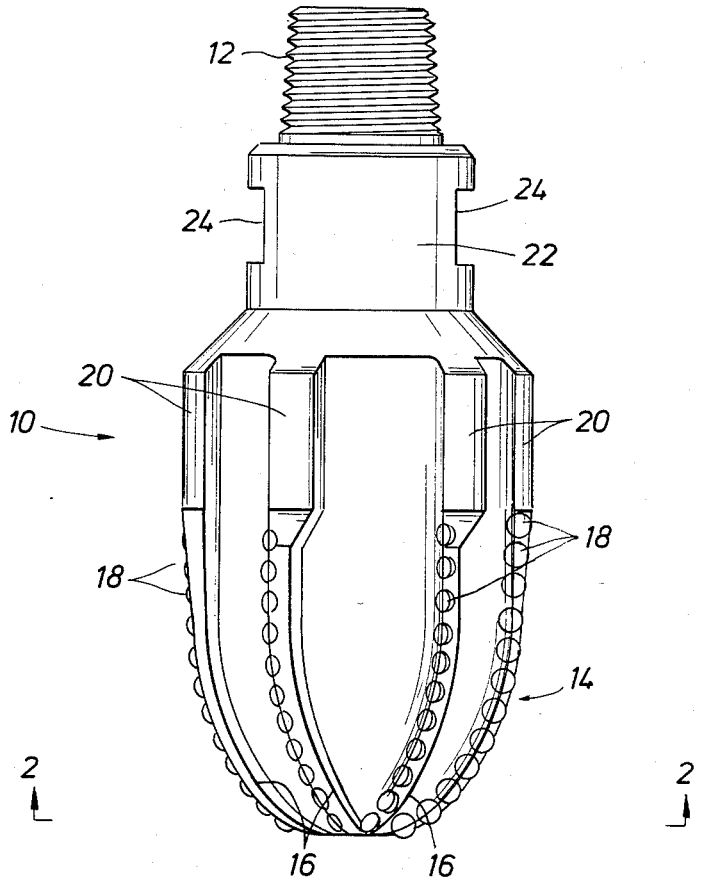
FIG. 1 is a side elevational view of a bit according to a first embodiment of the invention.
Figure 2:
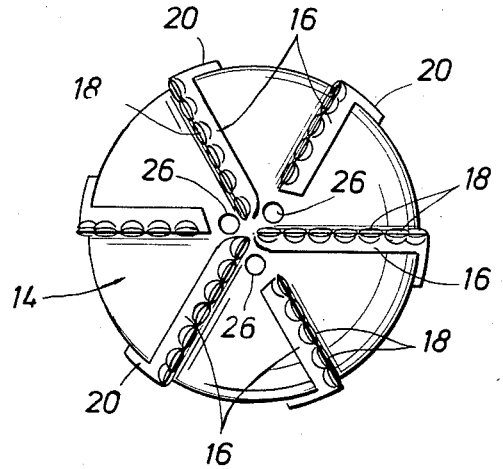
FIG. 2 is a plan view taken along the line 2—2 of FIG. 1.

FIGS. 1 and 2 depict a drill bit of the type in which the present invention may be incorporated. As used herein, "drill bit" will be broadly construed as encompassing both full bore bits and coring bits. Bit body 10, which is formed of tungsten carbide matrix infiltrated with a binder alloy, has a threaded pin 12 at one end for connection to the drill string, and an operating end face 14 at the opposite end. The "operating end face," as used herein includes not only the actual end or axially facing portion shown in FIG. 2, but contiguous areas extending up along the lower sides of the bit, i.e. the entire lower portion of the bit which carries the operative cutting members described hereinbelow. More specifically, the operating end face 14 of the bit is transversed by a number of upsets in the form of ribs or blades 16 radiating from the lower central area of the bit and extending across the underside and up along the lower side surfaces of the bit. Ribs 16 carry cutting members 18, to be described more fully below. Just above the upper ends of ribs 16, bit 10 has a gauge or stabilizer section, including stabilizer ribs or kickers 20, each of which is continuous with a respective one of the cutter carrying ribs 16. Ribs 20 contact the walls of the borehole which has been drilled by operating end face 14 to centralize and stabilize the bit and help control its vibration.

Intermediate the stabilizer section defined by ribs 20 and the pin 12 is a shank 22 having wrench flats 24 which may be engaged to make up and break out the bit from the drill string. Referring again to FIG. 2, the underside of the bit body 10 has a number of circulation ports or nozzles 26 located near its centerline, nozzles 26 communicating with the inset areas between ribs 16, which areas serve as fluid flow spaces in use.

Figure 3:
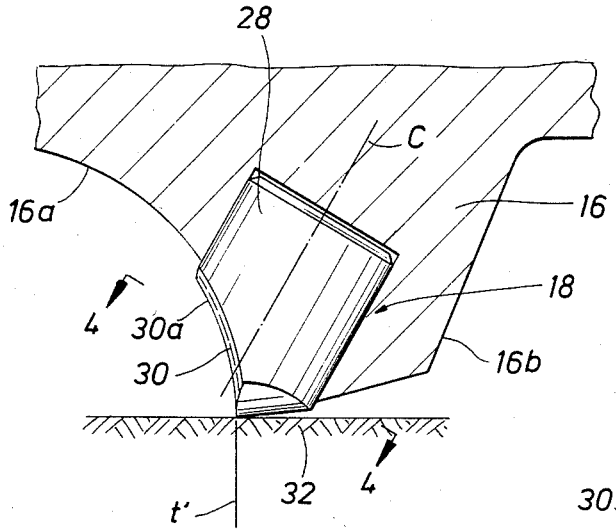
FIG. 3 is a detailed view, on a larger scale, showing a section through one of the ribs of the bit body with one of the cutting members shown in elevation.
Figure 4:
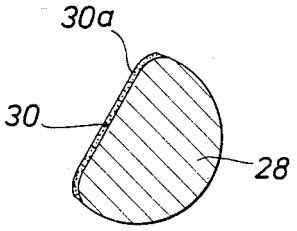
FIG. 4 is a detailed sectional view taken along the line 4—4 of FIG. 3.

Referring now to FIG. 3 in conjunction with FIGS. 1 and 2, bit body 10 is intended to be rotated in the counterclockwise direction, as viewed in FIG. 2. Thus, each of the ribs 16 has a leading edge surface **16*a* and a trailing edge surface 16*b*, as best shown in FIG. 3. As shown in FIGS. 3 and 4, each of the cutting members 18 is comprised of a mounting body 28—in the form of a stud of cemented tungsten carbide, and a layer 30 of polycrystalline diamond or other superhard material carried on the leading face of the stud 28 and defining the cutting face 30*a* of the cutting member. As used herein, "superhard" will refer to materials significantly harder than silicon carbide, which has a Knoop hardness of 2470, i.e. to materials having a Knoop hardness greater than or equal to 2500. The cutting members 18 are mounted in their respective ribs 16 so that their cutting faces are exposed through the leading edge surfaces 16*a***.

Layer 30, the underlying portion of stud 28, and the cutting face defined by layer 30 are all inwardly concave in a plane in which their back rake angle may be measured, e.g. the plane of FIG. 3. As mentioned, cutting face **30*a* is exposed through the leading edge surface 16*a* of the respective rib 16 in which the cutting member is mounted and, in fact, cutting face 30*a* is the leading surface of the cutting member. As shown in FIG. 3, the curved cutting face 30*a* is a surface having a number of different back rake angles, which angles become more negative with distance from the profile of the earth formation 32, i.e. the angles become more negative from the outermost to the innermost edges of cutting face 30*a*. (As used herein, "distance" is measured from the closest point on the profile.) For example, the original outermost edge of face 30*a* forms the initial cutting edge in use. It can be seen that a tangent $t_1$ to surface 30*a* at its point of contact with the earth formation 32 is substantially coincident with a normal to the surface at the same point. Thus, the back rake angle at the original outermost edge or cutting edge of surface 30*a*** is 0°.

FIG. 6 illustrates the same cutting member 18 and the associated rib 16 after considerable wear. The step formed between stud 28 and layer 30 by the self-sharpening effect is shown exaggerated. It can be seen that, after such wear, the tangent $t_2$ to the cutting face **30*a* at its point of contact with the earth formation 32 forms an angle $\alpha$ with the normal n to the profile of the earth formation at that point of contact. It can also be seen that a projection of the normal n would fall within the cutting member 18**. Thus, a significant back rake angle is now presented to the earth formation, and because the normal n falls within the cutting member, that angle is negative. More specifically, the back rake angle $\alpha$ is about $-10°$ as shown.

In use, relatively soft formations may often be drilled first, with harder rock being encountered in lower strata and/or small "stringers". As drilling begins, the cutting member 18 is presented to the earth formation 32 in the configuration shown in FIG. 3. Thus, the operative portion of surface 30 has a back rake angle of approximately 0°. With such a back rake angle, the bit can drill relatively rapidly through the uppermost soft formation about substantial or excessive wear of the cutting members. If and when harder rock is encountered, the cutting member, including both the superhard layer 30 and the stud 28 will wear extremely rapidly until the back rake angle presented to the earth formation is a suitable one for the kind of rock being drilled. For example, the apparatus may rapidly chip away until it achieves the configuration shown in FIG. 6, at which time the wear rate will subside to an acceptable level for the particular type of rock. Thus, the cutting member, with its varying back rake angles, is self-adjusting in the negative direction.

Having reached a configuration such as that shown in FIG. 6, with a relatively large negative back rake angle, suitable for the local formation, the cutting member 18 and the other cutting members on the bit, which will have worn in a similar manner, will then continue drilling the new hard rock without further excessive wear or damage. If, subsequently, soft formation is again encountered, the cutting members 18, even though worn to the configuration of FIG. 6 for example, can still continue drilling. Although they will not be able to drill at the fast rate permitted by the original configuration of FIG. 3, they will at least have drilled the uppermost part of the formation at the maximum possible rate, and can still continue drilling lower portions at a slower but nevertheless acceptable rate.

Thus, a bit equipped with cutters 18 will tend to optimize both drilling rate and bit life. The overall time for drilling a given well will be much less than if cutters with substantially negative back rake angles had been used at the outset. At the same time, there will be no undue expense due to a special trip to change from one drill bit to another as different types of formations are encountered. Likewise, there will be no danger of catastrophic failure as if cutters with small negative, zero or positive rake angles had been used throughout. It is noted, in particular, that if extreme wear is experienced, the surface **30*a*** of the cutting member illustrated and the surface of the other similar cutting members on the bit will present such large negative back rake angles to the formation that bit penetration will be effectively stopped in time to prevent the formation of junk by massive damage.

The curvature of cutting face **30*a* has other advantages as well, particularly in concert with related design features of the overall cutting member 18 and the rib 16 in which it is mounted. As shown in FIGS. 3 and 4, cutting face 30***a*, while curved in the planes in which back rake angles can be measured, is not curved, but rather is straight, in perpendicular planes such as that of FIG. 4. More specifically, face 30*a* defines a portion of a cylinder. This permits the leading edge surface 16*a* of rib 16 to be formed so as to generally parallel the cutting face 30*a*, as well as additional cutting faces of other cutting members mounted in the same rib. This "blending" of the curvatures of the leading edge of the rib and the various cutting faces exposed therethrough improves the hydraulics of the drilling mud across the bit.

Mounting body 28, being in the form of a peg-like stud, has a centerline C (FIG. 3) defining the longitudinal direction of the cutting member in general. Layer 30 and cutting face 30*a* defined thereby are laterally offset or eccentric with respect to the outermost end of stud 28 on which they are carried. However, face 30*a* is intersected by centerline C as shown. This feature, together with the parallel curvature of face 30*a* and leading edge surface 16*a* of the respective rib allow for a maximum amount of support for the cutting member within the rib 16. As shown in FIG. 3, the portion of the stud 28 generally opposite cutting face 30*a* is virtually completely embedded in and supported by the material of rib 16. As shown in FIG. 5, the lateral portions of the outermost end of stud 28 generally adjacent cutting face 30*a* are likewise substantially enveloped and supported by the material of rib 16. This substantial support helps to prevent damage to or loss of the cutting member in use. By comparison of FIGS. 3 and 5, it can be seen that almost the entirety of stud 28 is embedded in and supported by rib 16, while at the same time, the entirety of cutting face 30*a* is exposed for potential contact with the earth formation.

Still another advantage of the curved configuration of cutting face 30*a* is that it has a "chip breaker" effect. Briefly, if a chip of the earth formation begins to build up in front of cutting face 30*a*, the curvature of that face will tend to direct the forming chip up and over the cutting face, so that it breaks off and falls away, rather than accumulating on the leading side of the cutting face.

Figure 7:
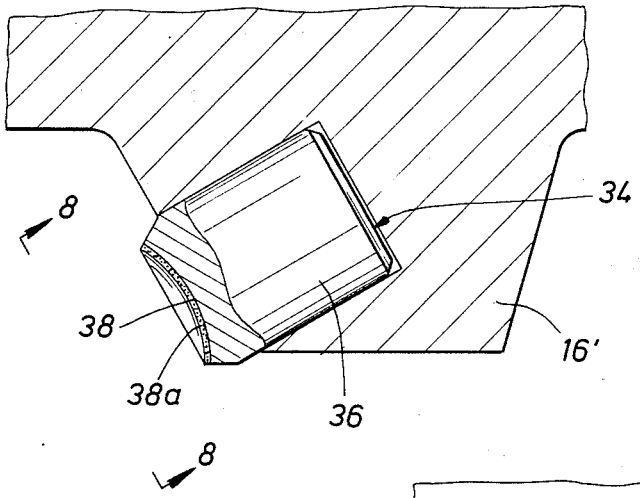
FIG. 7 is a view similar to that of FIG. 3 showing a second embodiment of cutting member.
Figure 8:
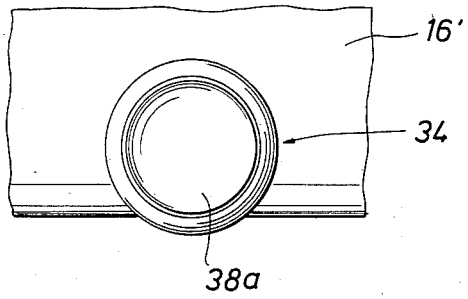
FIG. 8 is a view taken along the line 8—8 of FIG. 7.

Referring next to FIGS. 7 and 8, there is shown another form of cutting member which can be employed on a bit body similar to that shown in FIGS. 1 and 2. Like the cutting members 18 of the first embodiment, cutting member 34 of FIGS. 7 and 8 comprises a peg-like stud 36 of sintered tungsten carbide forming the mounting body of the cutting member and a layer 38 of superhard material, such as polycrystalline diamond, carried on the outermost end of stud 36 and forming the cutting face 38*a*. Likewise, cutting face 38*a* is curved so that it defines a plurality of back rake angles, becoming more negative with distance from the earth formation profile in use. However, unlike the layer 30 in the first embodiment, layer 38 in the embodiment of FIGS. 7 and 8 is arranged symmetrically on the end of stud 36. Another difference is that layer 38 and the cutting face 38*a* which it defines are curved in transverse planes; more specifically, they define a portion of a sphere. FIG. 7 illustrates the manner in which the angle of mounting of the stud 36 in a rib 16' of the bit body is varied (as compared to that of the preceding embodiment) to accommodate the symmetrical arrangement of layer 38 on stud 36 and provide maximum rib support for the stud 36 while still allowing full exposure of cutting face 38*a*.

FIGS. 9 and 10 illustrate still another form of cutting member 40 according to the present invention. Member 40 includes a mounting body in the form of a stud 42 of sintered tungsten carbide. Stud 42 carries a layer 46 of superhard material, not directly, but by means of an intermediate carrier pad 44, also of sintered tungsten carbide. Layer 46 of superhard material and the cutting face which it defines are, as in the preceding embodiments, concave inwardly. However, rather than defining a single smooth curve, the cutting face comprises a succession of contiguous flats 46*a*, 46*b* and 46*c*, each disposed angularly with respect to the next adjacent flat or flats, and each defining a different, successively more negative back rake angle. Thus, the embodiment of FIGS. 9 and 10 includes a concave cutting face which approximates the curved cutting face of the first embodiment, but which defines only three back rake angles, rather than an infinite number of back rake angles.

Referring finally to FIGS. 11–13, there is shown a scheme by which certain principles of the present invention can be applied utilizing conventional cutting members having planar cutting faces. FIG. 11 diagrammatically illustrates a bit body 50 whose profile generally parallels the profile 64 of the earth formation 66 in use, in the conventional manner. Bit body 50 carries a first set of cutting members 54 and a second set of cutting members 52. The cutting members of the two sets are arranged alternately on the bit body. As best shown in FIG. 13, the cutting members 54 each comprise a mounting body 60 and a layer 62 of superhard material defining a planar cutting face. As shown in FIG. 12, each cutting member 52 likewise comprises a mounting body 56 and a layer 58 of superhard material defining a planar cutting face. However, the cutting members of the two sets differ in two basic respects. The members 54 of the first set have their cutting faces disposed closer to the operating end face of the bit body than the cutting faces of the second set of cutting members 52. As seen by comparison of FIGS. 12 and 13, the two sets also differ in that the first or innermost set has its cutting faces disposed at substantial negative back rake angles, while the first set of cutting members 52 has its cutting faces arranged at a back rake angle of 0°. Thus, although the individual cutting faces are planar, the cutting faces of the various cutting members on the bit body together define surfaces having back rake angles which become more negative with distance from the profile 64 of the earth formation 66.

Accordingly, in use, the bit of FIG. 11 will begin to drill in soft formation as shown in the drawing, with only the outermost cutting members 52 contacting and drilling the earth formation. These outermost cutting members have zero back rake angles suitable for rapidly drilling the uppermost soft formation. If and when the hard rock is encountered, members 52 will rapidly break or chip away until members 54 are enabled to contact and begin drilling the earth formation. Because of their substantial negative back rake angles, members 54 will be able to drill the hard rock without excessive wear or damage.

The foregoing represent only a few exemplary embodiments of the present invention, and it will be understood that many modifications may suggest themselves to those of skill in the art. For example, in addition to the cylindrical and spherical cutting faces illustrated in the first two embodiments above, other concave curves such as toroidal or elipsoidal curves are possible as well as variable curves defining no standard geometrical form. Schemes similar to that of FIG. 11 may involve other arrangements of the large and small rake angle cutters on the bit body. For example, rather than providing both types of cutters on each row, alternate rows may be provided with large and small rake angle cutters respectively. The appropriate spacing of the various rows from the profile could be achieved by forming ribs or blades on the bit body, as in FIGS. 1 and 2, but with alternate ribs having different thicknesses.

The materials may be varied, but in any event, it is preferred that the material of the mounting bodies be significantly harder than that of the bit body, and that the material of the cutting layers be even harder, more specifically, "super-hard" as defined hereinabove.

Still other variations are possible. Accordingly, it is intended that the scope of the invention be limited only by the claims which follow.

What is claimed is:

1. A drag-type well-drilling bit comprising:

a bit body having an operating end face;

and a plurality of self-sharpening cutting members mounted in said bit body and extending through said operating end face, said cutting members having cutting faces adapted to engage an earth formation and cut the earth formation to a desired three dimensional profile, said cutting faces defining surfaces having back rake angles which become more negative with distance from said profile.

2. A bit according to claim 1 wherein each of said cutting members comprises a mounting body having a leading face and a relatively thin layer of superhard material carried on the leading face of said mounting body and defining said cutting face.

3. A bit according to claim 2 wherein said mounting bodies are comprised of a material significantly harder than that of said bit body but not as hard as said layer of superhard material.

4. A bit according to claim 3 wherein said superhard material comprises polycrystalline diamond.

5. A bit according to claim 4 wherein said mounting bodies comprise cemented tungsten carbide.

6. A bit according to claim 3 wherein each of said cutting faces has a plurality of back rake angles which become more negative with distance from said profile.

7. A bit according to claim 6 wherein each of said cutting faces comprises a succession of contiguous flats each having a respective such back rake angle.

8. A bit according to claim 6 wherein each of said cutting faces defines a concave curve in the plane of measurement of said back rake angles.

9. A bit according to claim 8 wherein said superhard material comprises polycrystalline diamond.

10. A bit according to claim 8 wherein the configuration of said operating end face defines a plurality of upsets each having a leading edge surface; wherein said mounting bodies of said cutting members are embedded in said upsets to mount said cutting members so that said cutting faces are exposed along said leading edge surfaces.

11. A bit according to claim 10 wherein the portion of each of said mounting bodies opposite said cutting face and lateral portions of said mounting body adjacent said cutting face are substantially embedded in and supported by the respective one of said upsets.

12. A bit according to claim 11 wherein the leading edge surfaces of said upsets are curved to generally parallel the curves of said cutting faces.

13. A bit according to claim 11 wherein said upsets are ribs each arranged to have a substantial radial component of direction with respect to said end face, and at least some of said ribs have a plurality of said cutting members so mounted therealong.

14. A bit according to claim 11 wherein each of said mounting bodies is a stud having a centerline intersecting the respective cutting face.

15. A bit according to claim 14 wherein each of said cutting faces defines a portion of a cylinder.

16. A bit according to claim 11 wherein each of said cutting faces defines a portion of a cylinder.

17. A bit according to claim 2 wherein there are at least two sets of said cutting members, one set having its cutting faces disposed closer to said operating end face than the cutting faces of the other set, and wherein the back rake angles of the cutting faces of said one set are less than the back rake angles of said cutting faces of said other set.

18. A bit according to claim 17 wherein said superhard material comprises polycrystalline diamond.

19. A bit according to claim 17 wherein said cutting faces are generally planar.

20. A drag-type well-drilling bit comprising:

a bit body having an operating end face;

and a plurality of cutting members mounted in said bit body and extending through said operating end face, each of said cutting members including a mounting body comprised of a material significantly harder than that of said bit and having a leading face, and a relatively thin layer of material even harder than that of said mounting body carried on the leading face of said mounting body and defining a cutting face;

said cutting faces being adapted to engage an earth formation and cut the earth formation to a desired three-dimensional profile, said cutting faces defining surfaces having back rake angles which become more negative with distance from said profile.

21. A bit according to claim 20 wherein said mounting bodies comprise cemented tungsten carbide, and said cutting faces are comprised of superhard material.

22. A bit according to claim 20 wherein each of said cutting faces has a plurality of back rake angles which become more negative with distance from said profile.

23. A bit according to claim 22 wherein each of said cutting faces defines a concave curve in the plane of measurement of said back rake angles.

24. A bit according to claim 20 wherein there are at least two sets of said cutting members, one set having its cutting faces disposed closer to said operating end face than the cutting faces of the other set, and wherein the back rake angles of the cutting faces of said one set are less than the back rake angles of said cutting faces of said other set.

25. A bit according to claim 2 wherein said leading face defines an outer edge of said mounting body, and wherein said layer of superhard material is generally uninterrupted and of generally uniform thickness over said outer edge of said mounting body.

26. A bit according to claim 25 wherein the leading face of each of said mounting bodies is inwardly concave parallel to the respective cutting face, and wherein said layer of superhard material is uninterrupted and of uniform thickness over a major part of said leading face.

* * * * *